US007251843B2

(12) United States Patent
Malloy et al.

(10) Patent No.: US 7,251,843 B2
(45) Date of Patent: Aug. 7, 2007

(54) COVER LID FOR A URINAL HAVING A FRESH SCENT COMPARTMENT

(76) Inventors: Claude Malloy, 71 Brand Dr., Huntington, NY (US) 11743; Leroy Malloy, 805 Paumanack Village Dr., Greenlawn, NY (US) 11740

( * ) Notice: Subject to any disclaimer, the term of this patent is extended or adjusted under 35 U.S.C. 154(b) by 0 days.

(21) Appl. No.: 11/656,302

(22) Filed: Jan. 22, 2007

(65) Prior Publication Data

US 2007/0136936 A1 Jun. 21, 2007

(51) Int. Cl.
*A47K 11/00* (2006.01)

(52) U.S. Cl. ..... 4/144.1

(58) Field of Classification Search ..... 4/144.1–144.3
See application file for complete search history.

(56) References Cited

U.S. PATENT DOCUMENTS 6,578,206 B1 * 6/2003 LaBrash ..... 4/144.1

* cited by examiner

*Primary Examiner*—Charles E. Phillips

(57) ABSTRACT

A cover lid for a urinal having a fresh scent compartment includes a basic portable urinal container with cover lid made to secure a new plastic hand on top of it. The basic portable urinal container is for receiving and storing the user's urine. The new plastic hand is for storing a fresh scented liquid inside, so the user can control the unpleasant odors found inside the urinal container. Finally, both the new cover lid & new plastic hand were specially made to be placed together to form a new compartment. In addition the new plastic hand has a screw on 24 mm flip-top cap w/valve for releasing the liquid from the new plastic hand into the urinal's container.

2 Claims, 4 Drawing Sheets

COVER LID FOR A URINAL HAVING A FRESH SCENT COMPARTMENT

BACKGROUND OF THE INVENTION

1. Field of the Invention

The present invention relates generally to a basic portable urinal container and more specifically to a new cover lid for a urinal having a fresh scent compartment designed for the purpose of sanitizing.

2. Description of the Prior Art

A basic portable urinal container being used on a daily basis can most definitely become undesirable from the unpleasant odors found inside the urinal container. In this respect, a new cover lid for a urinal having a fresh scent compartment, will allow a user a better & cleaner approach to urinate, when restroom facilities are unreachable. Also, the biggest problem with basic portable urinal container is trying to attain a sanitary condition. And just keeping this problem in mind, the present invention provides a newly designed cover lid made to secure a new plastic hand on top of it. In addition, the new plastic hand is being used for storing a fresh scent liquid inside, so a user can manually release the liquid from the new plastic hand into the urinal container for sanitizing.

SUMMARY OF THE INVENTION

When we all just look at the many problems for which a basic portable urinal is helpful. We can first say we know it solves a basic problem by providing a user with a place to urinate when restroom facilities are unavailable or unreachable. Also, a patient may require the use of a basic portable urinal due to temporarily immobilization or other medical conditions which prohibit them from reaching the restroom without assistance. Still other people find basic portable urinals useful in common situations such as during long car trips or during traffic jams when restroom facilities cannot be reached in a timely manner. Even leisure activities such as camping, hiking, boating, or fishing can present situations where basic portable urinals are desirable. However, just reusing a basic portable urinal requires that all of its parts be sufficiently cleaned, which can be time-consuming as well as an unpleasant task. And to avoid these problems, the present invention provides an advanced cover lid for a urinal having a fresh scent compartment. As such, the main purpose of the present invention is to provide a higher quality portable urinal which is easily assembled for urine storage and also provides a fresh scented liquid for sanitary cleaning of the urinal. To attain a sanitary condition, the present invention must comprise of a basic portable urinal container with cover lid made to secure a new plastic hand on top of it. The basic portable urinal container is made for receiving & storing the user's urine. The new plastic hand is for storing a fresh scent liquid inside, so the user can control all of the unpleasant odors found inside the urinal's container. In addition, the new cover lid and the new plastic hand are placed together to form a new compartment. In this respect, a new cover lid for a urinal having a fresh scent compartment will allow a user a better & cleaner approach to urinate, when restroom facilities are unreachable. In this regard the present invention has met the above identified need.

BRIEF DESCRIPTION OF THE DRAWINGS

The accompanying drawings illustrate various views and embodiments for carrying out the invention. In the drawings.

DETAILED DESCRIPTION OF THE INVENTION

Figure 1A:
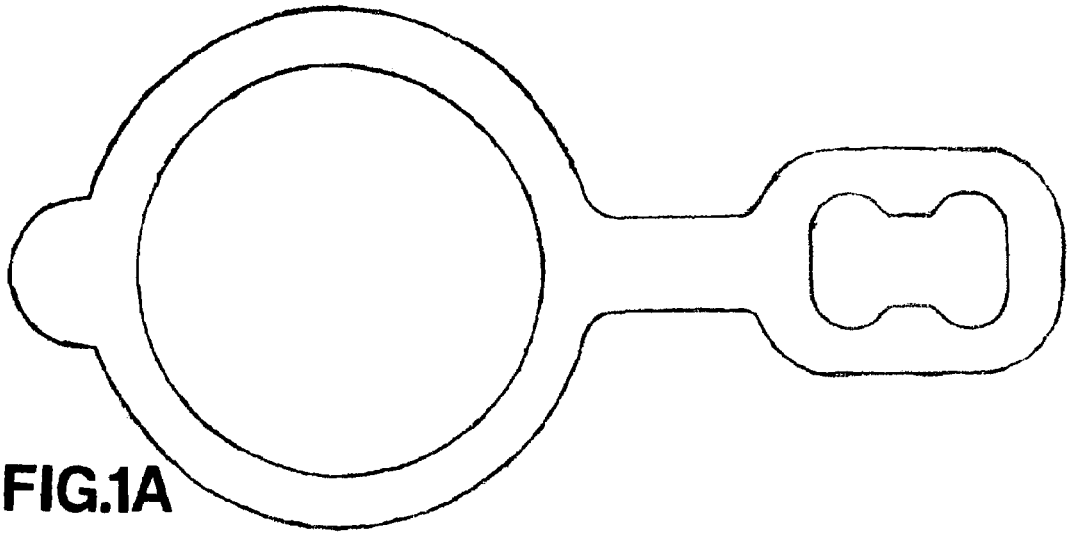
FIG. 1A is a view of a basic urinal's cover lid before {fraction (¾)} inch hole has been made in the middle of it according to the present invention.
Figure 1B:
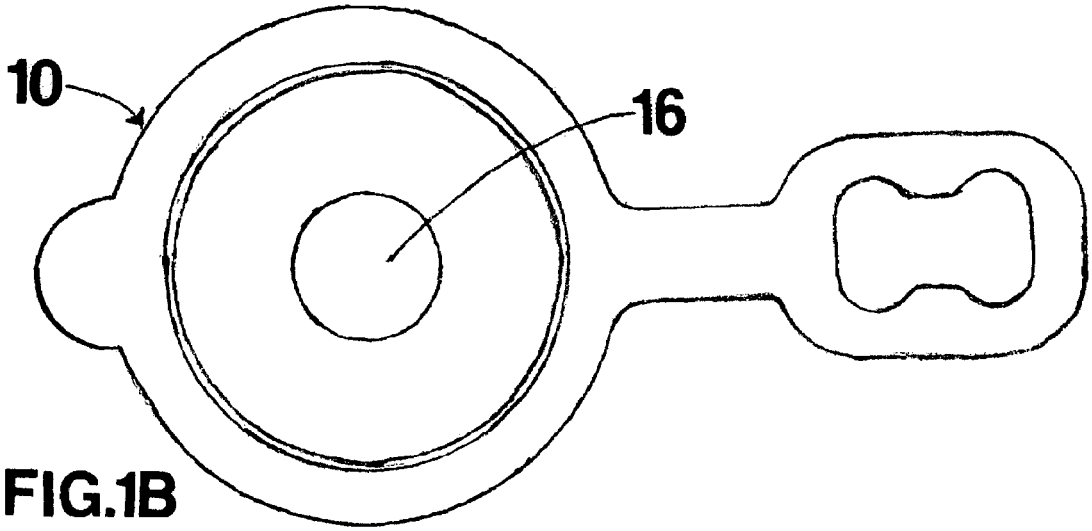
FIG. 1B is a view of a basic urinal's cover lid after {fraction (¾)} inch hole has been made in the middle of it according to the present invention.
Figure 2:
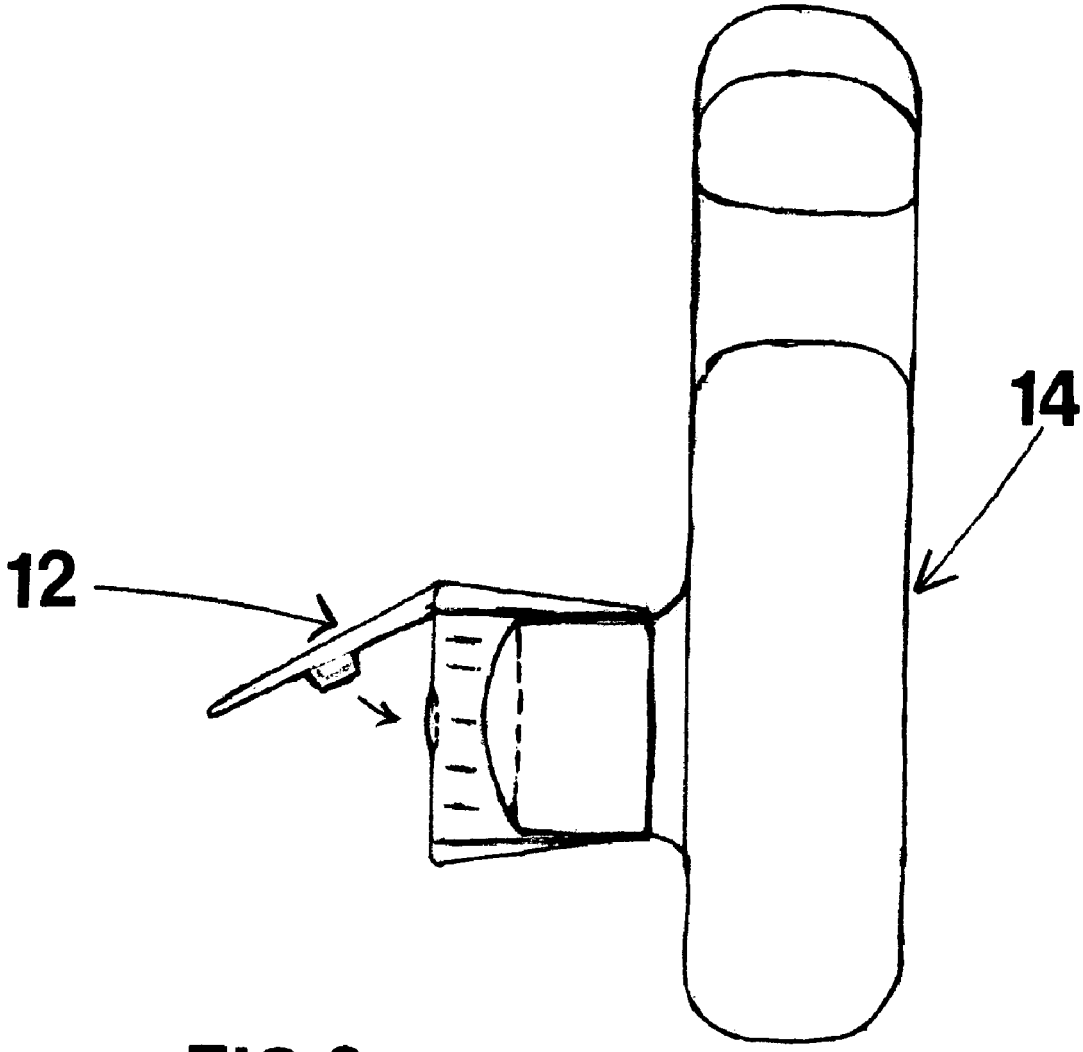
FIG. 2 is a top-side view of a 24 mm flip-top cap according to the present invention.
Figure 4:
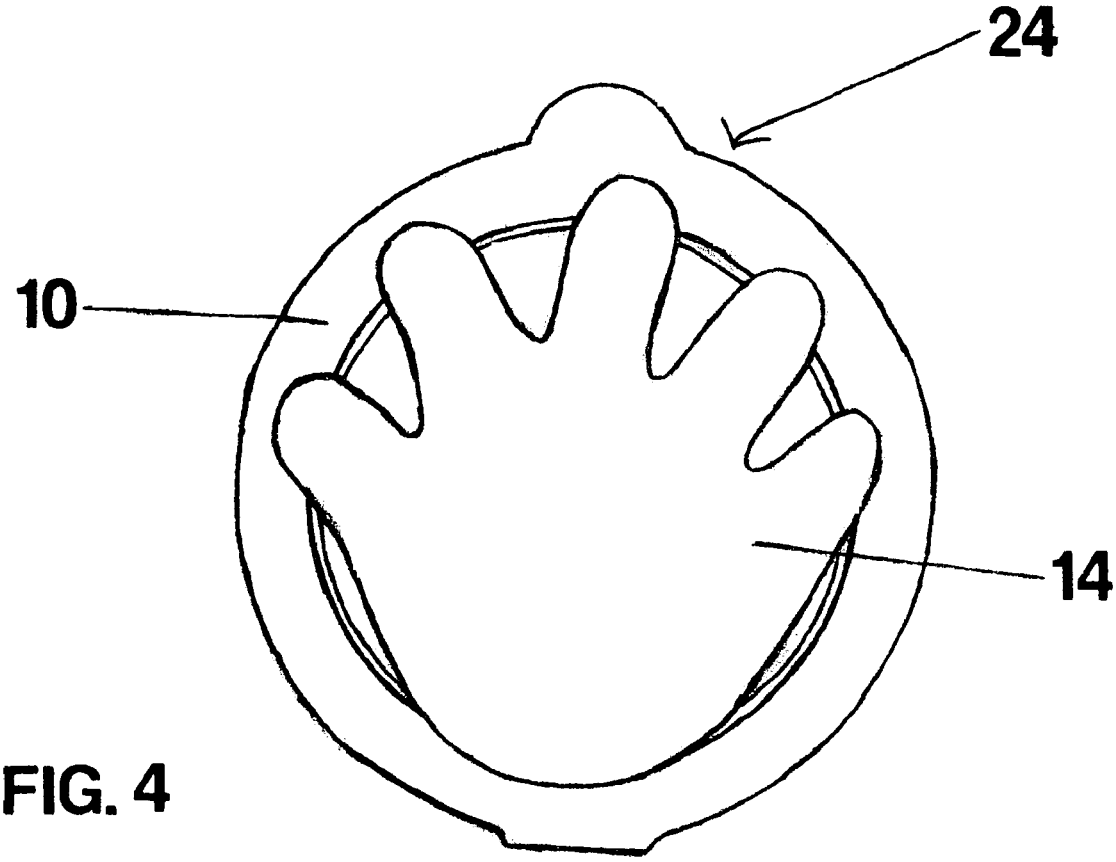
FIG. 4 is a top-side view of a new plastic hand placed on top of a cover lid according to the present invention.
Figure 5:
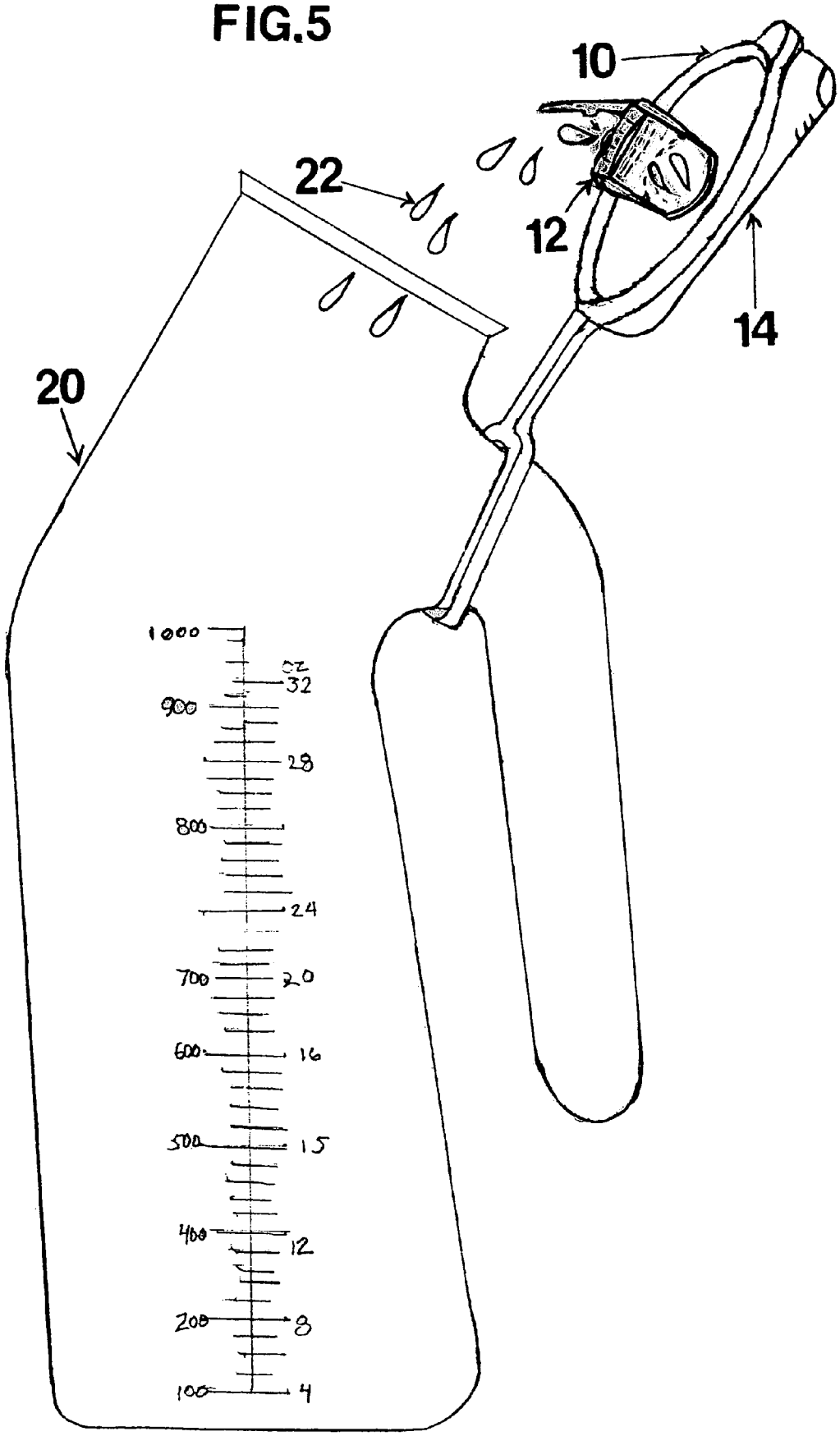
FIG. 5 is a perspective view of a cover lid for a urinal having a fresh scent compartment according to the present invention.

A cover lid for a urinal having a fresh scent compartment of the present invention is represented in FIGS. 1B, 4 and 5 by the reference numeral 10. In general, the cover lid assembly 10 for urinal container 20 is specially designed to hold a new plastic hand 14 on top of it. And as shown in FIG. 1B, the cover lid 10 has a {fraction (¾)} inch hole 16 made in the middle of it, and than connected together by a 24 mm flip-top cap 12 as shown in FIG. 2.

Figure 3:
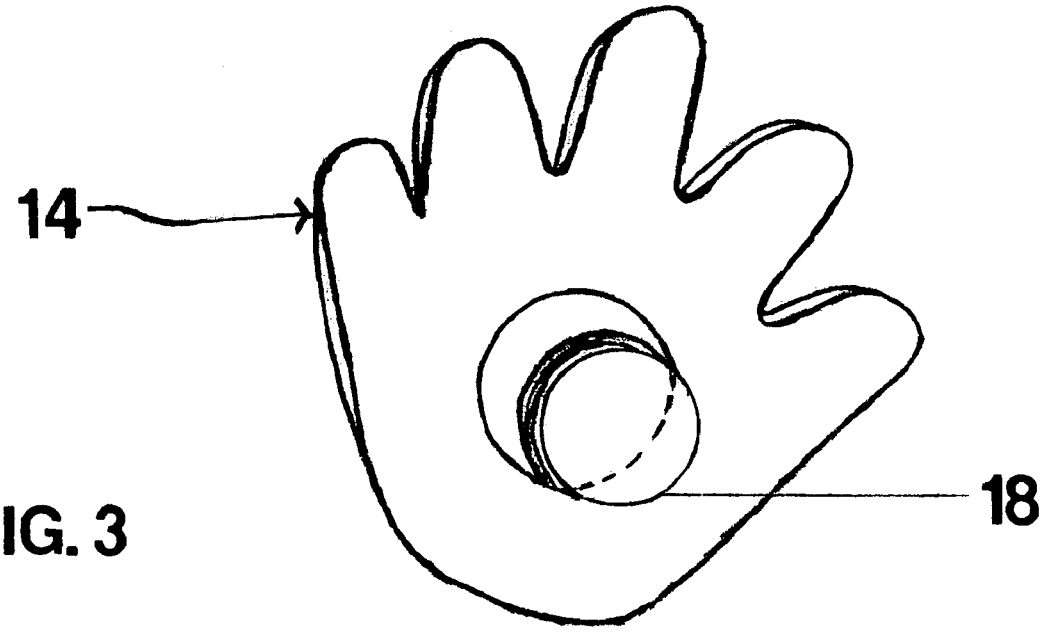
FIG. 3 is a bottom-side view of a new plastic hand according to the present invention.

Wherein, FIG. 3 is a bottom-side view of the new plastic hand 14 with a ¾ by ¾ inch neck with threads 18 on the palm area to secure the cover lid 10 to it. Now, as shown in FIG. 4 of the drawings, the new cover lid 10 & the new plastic hand 14 are placed together to form a new compartment 24. And, in addition a fresh scented liquid 22 is stored inside the new plastic hand 14 on top of cover lid 10 and placed onto handle of the urinal container 20. Finally, we screw on the 24 mm flip-top cap 12 onto matching threads 18 of new plastic hand 14 to form a cover lid 10 for a urinal 20 having a fresh scent compartment 24 according to the present invention.

Now, in FIG. 5, a user can manually put 24 mm flip-top cap 12 into an open valve position, press down on the plastic hand 14 to release a fresh scented liquid 22 into urinal container 20 for proper sanitizing according to the present invention.

What is claimed is:

1. A cover lid assembly for a portable urinal container that receives and stores the user's urine, comprising:

a cover lid assembly having a compartment for storing a fresh scent liquid to be dispensed into the urinal, a lid that seals a top opening of a urinal, said compartment being constructed of plastic and in the shape of a human hand, said compartment including a neck with threads, said neck being on an area that would correspond to a palm area of a human hand, a flip-top cap having threads thereon to mate with said neck threads so as to secure said lid between said compartment and cap via an opening in said lid, wherein the user can manually place said flip-top cap into an open position, then press downwardly on said plastic hand to release a fresh scent liquid into the urinal container for sanitizing the urinal.

2. The assembly of claim 1, wherein said opening is approximately three fourths of an inch in diameter.

* * * * *